US006106328A

United States Patent [19]

O'Neal

[11] Patent Number: 6,106,328

[45] Date of Patent: Aug. 22, 2000

[54] CABLE ASSEMBLY FOR USE WITH RJ45 JACKS

[76] Inventor: Daniel L. O'Neal, P.O. Box 215, Bryceville, Fla. 32009

[21] Appl. No.: 09/323,384

[22] Filed: Jun. 1, 1999

[51] Int. Cl.[7] ..... H01R 11/00

[52] U.S. Cl. ..... 439/503; 439/498; 439/623

[58] Field of Search ..... 439/502, 503, 439/504, 506, 623, 498

[56] References Cited

U.S. PATENT DOCUMENTS 5,391,095 2/1995 Born ..... 439/676

5,971,799 10/1999 Swade ..... 439/502

*Primary Examiner*—Paula Bradley
*Assistant Examiner*—Truc Nguyen
*Attorney, Agent, or Firm*—Arthur G. Yeager

[57] ABSTRACT

A Y-shaped connector cable assembly for use with three standard RJ45 telephone plugs includes eight wires connected to one plug. The eight wires are divided into two groups of four wires and directed to each of the other two plugs and connected to the respective operative pins so as to allow two devices to receive and send signals over the single cable assembly.

13 Claims, 2 Drawing Sheets

CABLE ASSEMBLY FOR USE WITH RJ45 JACKS

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

The present invention relates to cable assemblies, namely patching and interconnecting cables and particularly to Y-shaped connectors employing three standard RJ45 connecting plugs.

2. Related Art

There are a wide variety of connecting cables and patch cords known to the art of expanding the number of machines and devices that may be connected to a pre-wired network or other communication system. The known devices do not adequately deal with issues of cost and related issues of complexity of connection and the space requirements needed for the conventional approaches used. For example, U.S. Pat. No. 5,391,095 discloses a connecting block used to connect a single network cable to two separate devices. The block contains a first jack to receive the single cable. The first jack is wired to provide connections to two other jacks into which fit two respective plugs that connect to the two separate devices to be connected to the network. The principal limitation of such prior art connector is the fact that the plugs used are on patch cables that must be supplied and do take up valuable space. Accordingly, if a user has to connect between a switch panel in a cabinet and a patch panel, three patch cables would be needed in addition to the connecting block. Similarly, three patch cables and another block would be needed at the workstation where the additional devices are located. Furthermore, at both locations an additional jack must be used in the application. In summary, such a multi-jack approach of the prior art results in an excessive number of cables that are unnecessarily expensive and take up space. What is most desired is a simple, inexpensive connecting cable assembly usable in a wide variety of applications and one that minimizes the number of cables used and the space required for the cables used. None of the various plugs, jacks, and cable combinations known in the art are satisfactory.

BRIEF SUMMARY OF THE INVENTION

In one aspect of the present invention there is provided a cable assembly comprising a first length of cable including eight wires each having a first end portion and a second end portion and a first plug having eight pins designated sequentially from 1 to 8 for seating electrical contacts therein. The first portion of each wire is electrically connected to respective pin of the first plug. A second and third length of cable each carries a second end portion of a predetermined group of four of the eight wires. A second and third plug each having eight pins designated sequentially from 1 to 8 for seating electrical contacts therein, each of the wires in the second and third cable is electrically connected to respective pin of the respective second and third plugs to provide each of the second and third plugs with the contacts connected to the group of four wires. In other aspects of the invention the wires are arranged so as to electrically connect the numbered pins 1, 2, 4, and 5 of the first plug to the pins numbered 6, 3, 2 and 1 respectively of the second plug and the pins numbered 3, 6, 7 and 8 of the first plug to the pins numbered 1, 2, 6 and 3 respectively of the third plug. The first, second and third plugs are standard RJ45 plugs.

In other aspects of the present invention there is provided a cable assembly of eight wires, a first RJ45 plug having 8 pins designated sequentially 1–8 connected to each of the eight wires and a second and third RJ45 plug each having 8 pins designated sequentially 1–8 connected to four of the wires, the wires connected to pins designated 6, 3, 2 and 1 respectively, of the second plug, the wires connected to pins designated 3, 6, 7, 8 from the first plug being connected to pins designated 1, 2, 6 and 3 respectively of the third plug. There is also provided a cable assembly comprising three standard RJ45 plugs and eight wires, four of the wires being connected between pins 1, 2, 4, and 5 of a first plug and pins 6, 3, 2 and 1 respectively of the second plug, the other four of the wires being connected between pins 3, 6, 7 and 8 of the first plug and pins 1, 2, 6 and 3 of a third plug.

BRIEF DESCRIPTION OF THE SEVERAL VIEWS OF THE DRAWING

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DETAILED DESCRIPTION OF THE INVENTION

Figure 1:
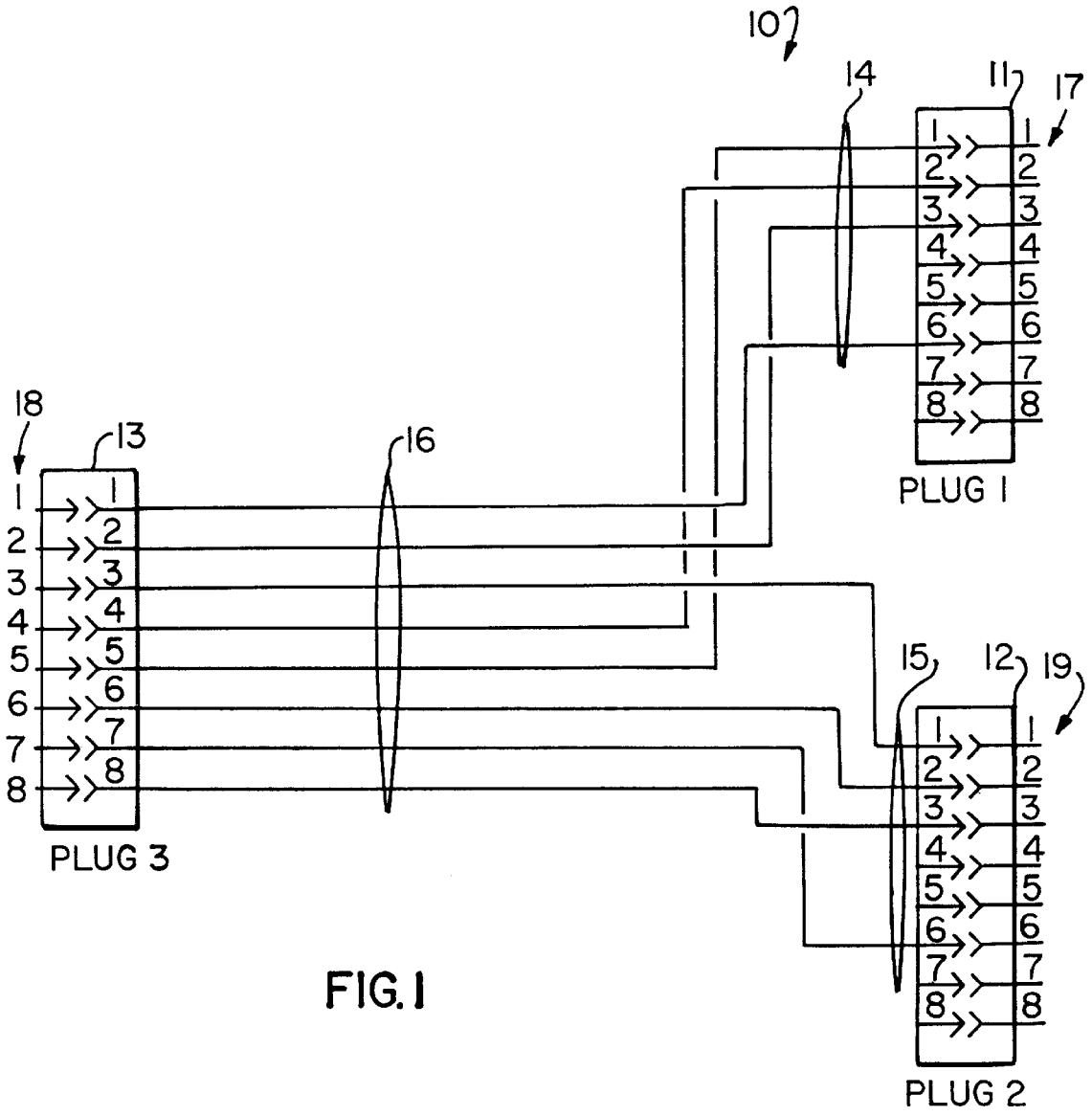
FIG. 1 is a simplified wiring diagram of the cable assembly in accord with the present invention.

With respect now to the drawings, a wiring diagram of the cable assembly 10 is shown in FIG. 1. Secondary plugs 11 and 12 include respective pin arrays 17 and 18 connected at four pins to main plug 13 having pin array 19. Plugs 11, 12 and 13 are all standard RJ45 plugs of the type used in standard telephones and elsewhere and have pin connections designated 1 to 8. Plug 13 is connected via output pins 1, 2, 4 and 5 to plug 11 at output pins 1, 2, 3, 6 and to plug 12 via output pins 3, 6, 7 and 8 at output pins 1, 2, 3, and 6 as clearly illustrated.

Figure 2:
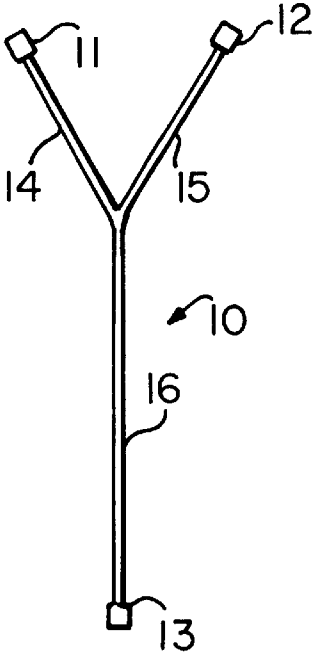
FIG. 2 is a pictorial view of the cable assembly of FIG. 1.

FIG. 2 illustrates the cable assembly 10 in the pictorial form of a Y-connector. Cable legs 14, 15 and 16 may be of any appropriate length and provide all the standard electrical insulation and other physical properties known to the art. Cable leg 16 carries eight wires. Each cable leg 14 and 15 carries four wires.

Figure 3:
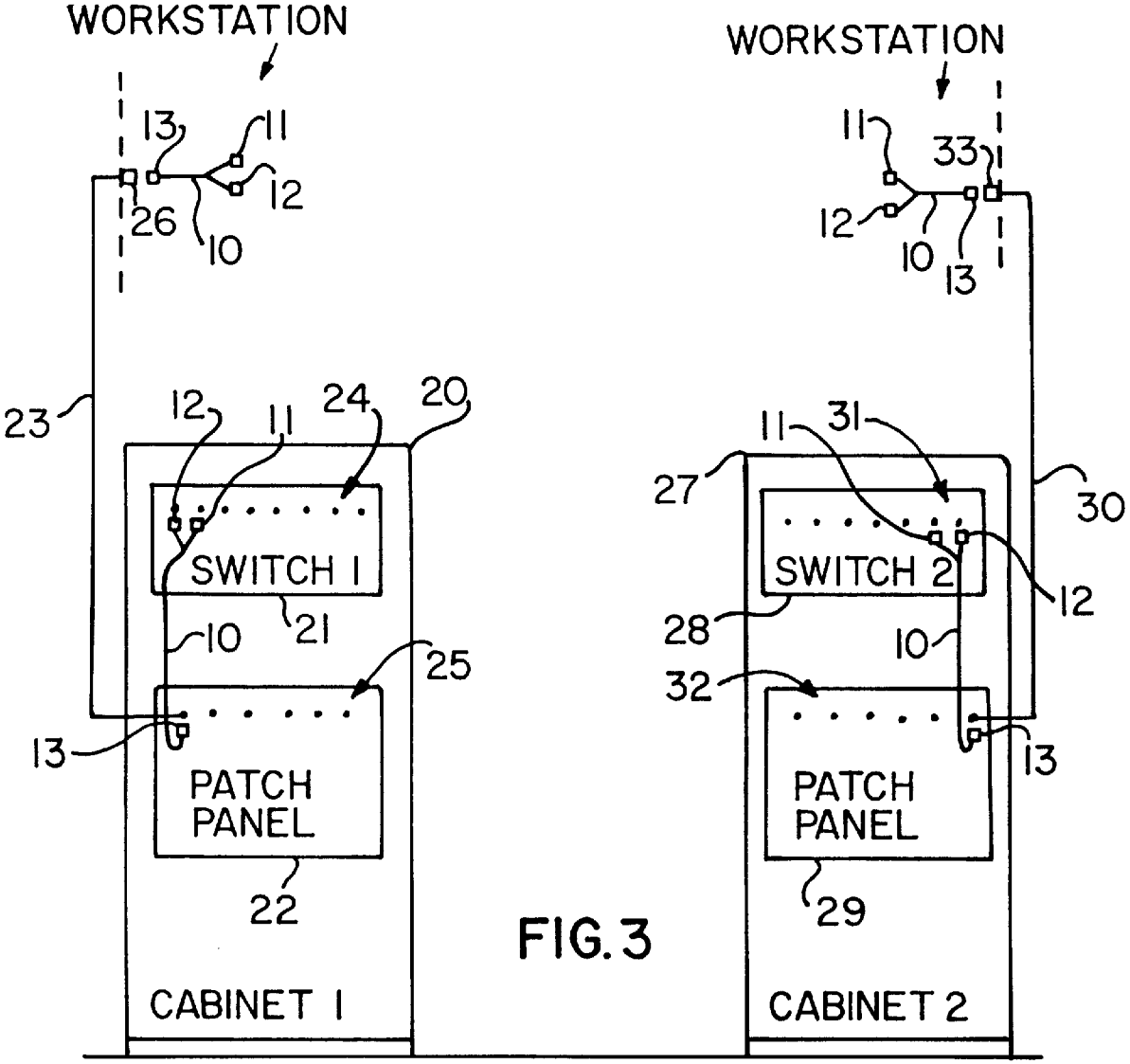
FIG. 3 is a simplified schematic illustrating a particular use of the cable assembly in accord with the present invention.

FIG. 3 illustrates an application of the Y-connector cables 10 to a network (not shown) represented by two switching cabinets 20 and 27. Cabinet 20 includes a switching panel 21 having a jack array 24 into which plugs 11 and 12 are inserted. Plug 13 is inserted into jack array 25 of patch panel 22. Patch panel 22 is connected via 8-wire cable 23 that represents the type of pre-existing wiring found in most buildings. Cable 23 extends through a wall (shown in broken line) to jack 26. Plug 13 of a second Y-connector cable 10 provides dual outputs to plugs 11 and 12 to, for example, a PC having a fax machine and a printer. Accordingly, two cables 10 are all that is needed to greatly expand the network capability at a given workstation.

Cabinet 27 is connected in a similar fashion. Cable 10 connects between switching panel 28 with jack array 31 and patch panel 29 having jack array 32. Cable 30 connects between patch panel 29 and workstation at jack 33 wherein another cable 10 is used as desired.

Cable 10 is designed to be used with standard equipment and to minimize the number of patch cords and the like now in use and also to avoid the necessity of rewiring the facility by adding more cables such as 23 and 30 with the corresponding jacks 26 and 33.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

Drawings

Enclosed on Separate Sheets.

Sequence Listing

Not Applicable.

What is claimed is:

1. A cable assembly comprising a first length of cable including eight wires each having a first end portion and a second end portion, a first plug having eight pins designated sequentially from 1 to 8 for seating electrical contacts therein, said first portion of each said wire electrically connected to respective said pin of said first plug, a second and third length of cable each carrying said second end portion of a predetermined group of four of said wires, a second and third plug each having eight pins designated sequentially from 1 to 8 for seating electrical contacts therein, each of said wires in said second and third cable electrically connected to respective said pin of respective said second and third plugs to provide each said second and third plugs with said contacts connected to said group of four said wires.

2. The cable assembly as defined in claim 1 wherein said wires are arranged so as to electrically connect said numbered pins 1, 2, 4 and 5 of said first plug to said pins numbered 6, 3, 2 and 1, respectively of said second plug and said pins numbered 3, 6, 7 and 8 of said first plug to said pins numbered 1, 2, 6, and 3, respectively of said third plug.

3. The cable assembly as defined in claim 1 wherein said first, second and third plugs are standard RJ45 plugs.

4. The cable assembly as defined in claim 2 wherein each said plug is standard RJ45 plug.

5. A cable assembly comprises eight wires, a first RJ45 plug having 8 pins designated sequentially 1–8 connected to each of said eight wires and a second and third RJ45 plug each having 8 pins designated sequentially 1–8 connected to four of said wires, said wires connected to pins designated 1, 2, 4, 5 from said first plug being connected to pins designated 6, 3, 2 and 1 respectively, of said second plug, said wires connected to pins designated 3, 6, 7, 8 from said first plug being connected to pins designated 1, 2, 6, and 3 respectively of said third plug.

6. An electrical cable assembly comprising a cable of a predetermined length including eight elongated wires each having a first end portion and a second end portion, a first electrical plug having eight pins designated sequentially from 1 to 8 for seating electrical contacts therein, said first portion of each said wire being electrically connected to respective said pin of said first plug, said first cable having said second end portions of said wires split into two equal groups and formed into second and third cable portions, cable portions each carrying said second end portion of a predetermined group of four of said wires, a second and third plug each having eight pins designated sequentially from 1 to 8 for seating electrical contacts therein, each of said wires of said second and third cable portions being electrically connected to respective said pin of respective said second and third plugs to provide each said second and third plugs with said contacts connected to said group of four said wires.

7. The assembly as defined in claim 6 wherein said first, second and third plugs are standard RJ45 plugs.

8. The assembly as defined in claim 6 wherein said wires are arranged so as to connect said pins numbered 1, 2, 4 and 5 of said first plug to said pins numbered 6, 3, 2 and 1, respectively of said second plug and said pins numbered 3, 6, 7 and 8 of said first plug to said pins numbered 1, 2, 6 and 3, respectively of said third plug.

9. The assembly as defined in claim 8 wherein each said plug is a standard RJ45 plug.

10. In a system employing one RJ45 jack mounted at one location and two RJ45 Jacks mounted at another location, a cable assembly comprising a first length of cable including eight wires each having a first end portion and a second end portion, a first plug having eight pins designated sequentially from 1 to 8 for seating electrical contacts therein, said first portion of each said wire electrically connected to respective said pin of the first plug, a second and third length of cable each carrying said second end portion of a predetermined group of four of said wires, a second and third plug each having eight pins designated sequentially from 1 to 8 for seating electrical contacts therein, each of said wires in said second and third cable electrically connected to respective said pin of respective said second and third plugs to provide each said second and third plugs with said contacts connected to said group of four said wires, said first plug being adapted to be installed in said one RJ45 jack, and said second and third plug being adapted to be respectively installed in said two RJ45 jacks.

11. In the system as defined in claim 10 wherein said wires are arranged so as to electrically connect said numbered pins 1, 2, 4 and 5 of said first plug to said pins numbered 6, 3, 2 and 1 respectively, of said second plug and said pins numbered 3, 6, 7 and 8 of said first plug to said pins numbered 1, 2, 6, and 3, respectively of said third plug.

12. In the system as defined in claim 10 wherein said first, second and third plugs are standard RJ45 plugs.

13. In the system as defined in claim 11 wherein each said plug is a standard RJ45 plug.

* * * * *